United States Patent [19]

Keller

[11] 4,192,651

[45] Mar. 11, 1980

[54] METHOD OF PRODUCING PULVERULENT CARBONACEOUS FUEL

[75] Inventor: Leonard J. Keller, Dallas, Tex.

[73] Assignee: The Keller Corporation, Dallas, Tex.

[21] Appl. No.: 935,351

[22] Filed: Aug. 21, 1978

Related U.S. Application Data

[63] Continuation-in-part of Ser. No. 853,031, Nov. 22, 1977, Pat. No. 4,146,366.

[51] Int. Cl.[2] ..... C10L 9/10

[52] U.S. Cl. ..... 44/1 SR; 44/1 R; 203/88; 208/8 LE

[58] Field of Search ..... 44/1 R, 1 SR; 208/8 LE; 203/88

[56] References Cited

U.S. PATENT DOCUMENTS

| | | | |
|---|---|---|---|
| 2,784,148 | 3/1957 | Edmonds et al. | 203/88 X |
| 3,607,667 | 9/1971 | Knapp et al. | 203/88 X |
| 3,729,042 | 4/1973 | Burnett | 203/88 X |
| 4,030,893 | 6/1977 | Keller | 44/1 B |

*Primary Examiner*—Carl F. Dees

*Attorney, Agent, or Firm*—Wofford, Fails & Zobal

[57] ABSTRACT

A method of producing dry, pulverulent, low-density, high-porosity, high-permeability, highly-reactive carbonaceous fuel from slurries of coal and alcohol or stabilized suspensoids of coal and alcohol by single stage flashing. The slurries or suspensoids are heated under pressure to a temperature sufficient to effect single stage flashing of substantially all of the alcohol. The product resulting from flashing then is separated into vapors and solid particulate carbonaceous material. The vapors are condensed into alcohol for reuse and the particulate carbonaceous material is processed further or used as desired.

8 Claims, 1 Drawing Figure

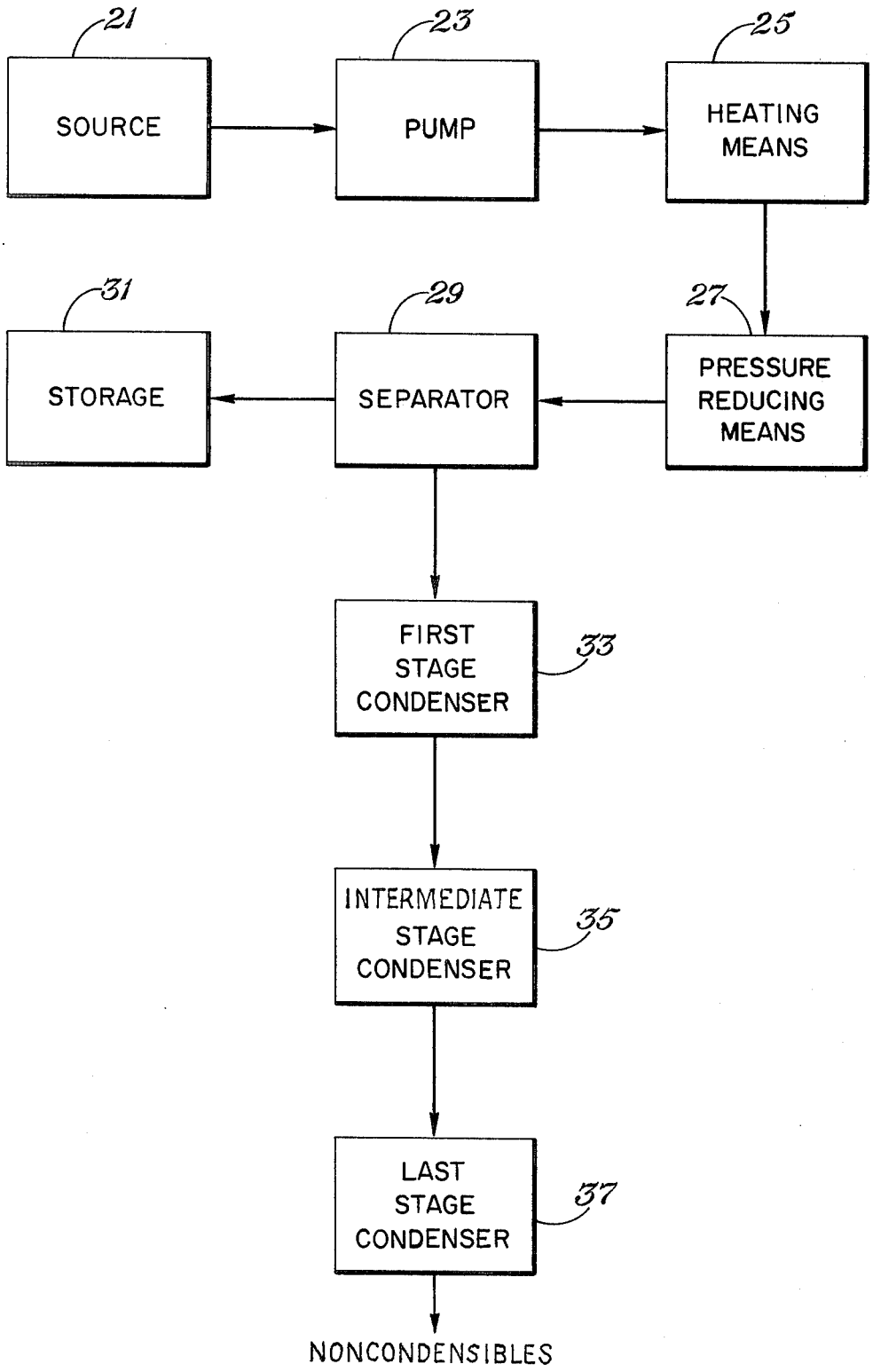
21
SOURCE
23
PUMP
25
HEATING MEANS
31
STORAGE
29
SEPARATOR
27
PRESSURE REDUCING MEANS
FIRST STAGE CONDENSER
33
INTERMEDIATE STAGE CONDENSER
35
LAST STAGE CONDENSER
37
NONCONDENSIBLES

METHOD OF PRODUCING PULVERULENT CARBONACEOUS FUEL

This application is a continuation-in-part of U.S. patent application Ser. No. 853,031, filed Nov. 22, 1977 and now U.S. Pat. No. 4,146,366.

This invention embodies technology in document disclosure No. 059985, dated Apr. 27, 1977 by the same inventor and entitled "Method for Producing Dry, Low-Density, High-Porosity, High-Permeability Pulverulent Carbonaceous-Hydrocarbonaceous Fuels from Either Slurries or Stabilized Suspensoids (Shear Thinning Fluids) of Coal, Lignite, or Other Carbonaceous Fuels in Alcohol or Alcohols with Various Limited Amounts of Water Present or at Essentially Zero Moisture Content."

BACKGROUND OF THE INVENTION

1. Field of the Invention

This invention relates to a process of separating coal particles from alcohol by single stage flashing.

2. Description of the Prior Art

U.S. Pat. No. 4,030,893 refers to my co-pending U.S. patent application Ser. No. 615,697 which discloses and claims a stabilized pseudo-thixotropic suspensoid of coal and alcohol which is employed to solve the problem of transporting coal through a pipeline. The coal and alcohol suspensoid also is described in the newsletter, *Energy Studies,* published by the Center for Energy Studies at the University of Texas at Austin, Volume 3, No. 2, November–December 1977.

From an economical standpoint it is desirable to separate the transported coal from the alcohol carrier and use only the coal as a fuel. From a practical standpoint, the separation process must be an economical one which allows separation of large quantities of materials.

U.S. Pat. No. 4,030,893 discloses a separation process called "flashing" which is well known in the prior art. Basically the flashing process consists of dropping the pressure of a heated liquid to a sufficiently low pressure so that a portion of the liquid spontaneously vaporizes, therefore effecting a drop in temperature which stabilizes the remaining liquid at its saturation pressure condition imposed by the process. Only a relatively small percentage of the liquid phase material may be converted to vapor in conventional flashing. Therefore, in order to convert most, or perhaps all, of a mass of liquid to vapor, several sequential cycles of liquid pressurizing, heating, then pressure reduction, followed by removal of the vaporized portion must be performed.

Such a process requiring a number of sequential cycles is not economical for separating the coal from the alcohol carrier particularly when large quantities of material are involved which would be the case in the pipeline transporation of the material.

SUMMARY OF THE INVENTION

It is an object of the present invention to economically separate coal or other carbonaceous fuel from alcohol by a single stage flashing process.

It is a further object of the present invention to produce a dry, highly-reactive, pulverulent particulate fuel of low density, high porosity, and high permeability from the single stage flashing process.

These and other objects will become apparent from the following descriptive matter taken in conjunction with the appended drawing.

BRIEF DESCRIPTION OF THE DRAWINGS

The FIGURE shown is a flow diagram of the present invention.

DESCRIPTION OF THE PREFERRED EMBODIMENTS

The coal that is employed in this invention may be any of the commercially available coals, ranging from the relatively pure and high carbon content anthracite coal through the bituminous coals to and including the less desirable soft coals, lignite and the like.

For transportation through a pipeline, the coal is crushed, pulverized, and worked in the presence of alcohol to form the suspensoid of coal in alcohol as described in U.S. patent application Ser. No. 615,697 mentioned above, and in the newsletter, *Energy Studies,* also mentioned above. The suspensoid may be described as a mechanically stabilized psuedo-thixotropic suspensoid of particulate carbon-hydrocarbon particles derived from coal or other carbonaceous materials suspended in alcohol as a base fluid or carrier and suspended in a ratio of solids to liquids that essentially precludes the possibility of settling. Pipeline transportation of coal-alcohol as a suspensoid is economical since it takes less energy per unit of fuel to pump the suspensoid and in addition two-thirds of the material by weight is carbon.

The alcohol employed for forming the suspensoid preferably is a methyl fuel which is a mixture of crude alcohols predominantly methanol and which may include smaller amounts of ethanol, n-propanol or isobutanol. These alcohols all include one to four carbon atoms. If the coal is to be used for chemical processes, gassification, or as a dried combustion fuel which is either burned by itself or mixed with other hydro-carbon fuels, the coal particles in alcohol will be of a size range predominantly from 10 to 100 microns.

Referring now to the drawing, there will be described the method of the present invention for separating the coal from the alcohol carrier. Reference numeral 21 depicts a pipeline, in which the suspensoid of coal particles in alcohol is transported from a distant location, or a storage facility where the fluid suspensoid is stored after being transported from the distant location through a pipeline. From the facility 21, the suspensoid is pumped continuously by pumping means 23 to a heating means 25. The pumping means provides high pressures and high volume capacity flow rates for the fluid. The pressures employed are sufficient to prevent vaporization during heating and may be from a few hundred pounds per square inch, to over 1000 pounds per square inch, depending on the nature of the volatilizable materials in the fluids. From the heating means 25, the heated fluid is flowed to a controllable pressure-reduction device 27 to maintain back-pressure on the heating means and to instantaneously drop the pressure exiting the device 27 to near-atmospheric pressure to allow flashing to vapor. The output of the pressure-reduction device 27 comprises a mixture of saturated dry vapor and dry solids. This output mixture is flowed to a gas/solids separator device 29, heated to prevent condensation of vapors, to remove the particulate solids from the gas stream either as a single product or divided by settling velocity separation into various particle-size fractions which may be defined for example, as fine, medium and coarse. From the separator 29 the solids are collected in hoppers integral with the separator and purged of alcohol vapors by hot inert gas, then removed to storage means 31 for storage under inert gas i.e. $CO_2$ or $N_2$. The separated vapors are applied to sequential condensers 33, 35, and 37 as will be described subsequently.

In the heating means 25 the fluid suspensoid is heated to a temperature sufficient to allow single stage flashing to take place in the pressure-reduction device 27. For this to occur, the fluid suspensoid must be heated to a temperature of at least about 200° F. above the original fluid temperature and which is approximately the minimum for complete vaporization of the alcohols. By dropping the pressure rapidly from several hundred pounds per square inch (to over one thousand pounds per square inch) down to atmospheric pressure, the enthalpy that has been put into the carbon material by heating is sufficient, in addition to the heat energy that is in the alcohol, to effect total flashing to complete dry vapor of substantially 100% of the alcohol in single stage flashing. Thus separation of the coal particles from the vapors by way of the separator 29 is economical since sequential cycles are not required and separation can be carried out in a continuous flow process.

In the heating means 25, the fluid suspensoid may be heated to temperatures above the minimum required for single stage flashing to occur, for example up to 600° F. to 800° F. above ambient or higher for the purpose of vaporizing and recovering valuable by-products or for the purpose of recovering organic compounds from the coal. As the temperature of the suspensoid is increased, more by-products can be recovered from the materials that are contained within the coal structure other than alcohol and which are volatilizable such as waxes, paraffins, resins, etc. At about 700° F. to 800° F. above ambient the alcohol will begin breaking down into atomic hydrogen and carbon monoxide. When this happens, the hydrogen will attack those chemicals present for which it has the greatest affinity or greatest potential for chemical reaction. For example, atomic hydrogen will combine with organic sulfur to remove it from practically any other compound. Not only the organic sulfur will be removed but also some of the inorganic sulfur will be removed.

The heating preferably is done in a mono-tube or parallel-tube heat exchanger in which sufficient fluid velocity is maintained to insure good heating transfer rates, and turbulence is introduced, or effected, to provide uniform heating of the fluid, both the liquid materials and the solid materials. Sufficient retention time is provided to allow heating throughout the individual particles of solid material. This is desired for providing the energy required for vaporizing, pressuring, and removing the volatilizable materials from within the particles and for effecting increased porosity and permeability and also for effecting further comminution by fragmentation during the next phase of processing which is the pressure reduction. The pressure-reduction device 27 may be either an adjustable venturi restriction, or an expansion motor, or some other flow-restricting device to drop the pressure and intiate flashing and evaporation. The separator 29 is a gas-solids separator such as a bag house, cyclonic separator, multiclone cyclonic separator, etc.

As mentioned above, the product resulting from flashing will be a mixture of saturated dry vapor and dry solid. The solids resulting from the flashing and which are separated by the separator are of a different nature than the crushed and pulverized carbon worked with the alcohol to form the suspensoid. In this respect, the flashing effects the surface texture, the internal pore space, the internal surface area, and the permeability of the particles and this results in the production of dry, pulverulent, low-density, high porosity, high permeability, high-reactivity particles. The resulting separated solids can be used as fuels, as feed stock for gassification, for chemical processes or for mixture with other hydrocarbon fuels such as diesel fuel. From the separator, the solids may be separated into different grades of sizes depending upon the usage desired.

The vapors from the separator are applied to the sequential condensers 33, 35 and 37 which are commercially available condensers which gradually drop the temperature for sequential condensation. The first stage condenser removes water or if any is present, hydrocarbons and by-product chemicals which condense at the 180° F. to 220° F. range and most of the particulate carbon which is not removed by the separator 29. The second stage, or intermediate, condenser 35 removes the alcohols and lower boiling-temperature hydrocarbons, and also some by-product chemical compounds, depending on the nature of the coal or lignite source. It is desirable to recover all of the alcohols since they are more costly than the other materials and can be used at the destination location for commercial purposes or sent back to the distant location by way of a second pipeline to be used as a carrier for transporting the coal from the distant location to the final destination point. The last stage condenser 37 may strip any low-boiling hydrocarbons and traces of alcohol and may be operated lower than ambient temperature or at elevated pressure (both) if found feasible for some materials. From the condenser 37 the non-condensible gas is pumped out and exhausted to the atmosphere. These gases may be treated to remove contaminants if required or necessary. They may also be burned as an additive fuel, if high enough in fuel value.

Although the preferred embodiment has been described as a process for single stage flashing of a stable suspensoid of coal particles and alcohol, it is to be understood that the process could be employed for single stage flashing of a slurry comprising a mixture of coal particles and alcohol of the same type as mentioned above. The temperature at which the slurry of coal and alcohol would be heated for single stage flashing may be slightly higher than that of the stable suspensoid of coal and alcohol because of the difference of specific heat in the carbon and alcohol. In this respect, the carbon has a specific heat of approximately 0.2 while that of alcohol is about 0.6. The specific heat of the stable suspensoid of carbon and alcohol is about 0.33 since it is about two-thirds of carbon in weight. A slurry cannot be effectively handled at a ratio of more than about 50% solids to liquid. Thus the specific heat for the coal-alcohol slurry would be slightly higher than that of the stable suspensoid of coal and alcohol and would require a somewhat higher temperature for flashing.

The slurry may be formed specifically for flashing in order to remove the undesirable by-products from the coal in order to produce a clean burning high quality fuel. Similarly the stable suspensoid of coal and alcohol may be also formed specifically for flashing purposes in order to remove the undesirable by-products for the purpose of producing a clean burning high quality fuel.

While first, second and third stages of flashing have been described hereinbefore, any number of stages of flashing can be employed as desired for separating constituents.

Having thus described the invention, it will be understood that such description has been given by way of illustration and example and not by way of limitation, reference for the latter purpose being had to the appended claims.

I claim:

1. A method of producing dry, pulverulent, highly-reactive particulate fuel of low density, high porosity, and high permeability, from a fluid material comprising carbonaceous fuel particles and alcohol, comprising the steps of:

pressurizing said fluid material to a level sufficient to prevent vaporization of liquids or solids during heating to a temperature T1, heating said pressurized material under pressure to a temperature T1 sufficient to effect single stage flashing of substantially all of the alcohol and high enough that the temperature of the remaining solids after the single stage flashing of substantially all of the alcohol is above the condensing temperature T2 of said alcohol and any water vaporized therewith, passing said heated fluid material to expansion means to reduce the pressure rapidly to initiate flashing and vaporization of substantially all of the alcohol in said fluid material as well as other volatized materials and leave a puffed, dry, pulverulant, highly-reactive particulate fuel as the solids, and maintaining said solids above the temperature T2 until after said vapors that have been flashed have been separated from said solids, passing the resulting solid particulate material and vapor mixture from said expansion means to a gas-solids separator means to separate the vapors from the solid particulate material while maintaining said solids above said temperature T2 so as to prevent said condensation of said vapors, and removing the separated vapors and solid particulate material from said separator.

2. The method of claim 1 comprising the step of condensing the separated vapors from said separator means to recover alcohol.

3. The method of claim 1 wherein said carbonaceous material is coal having extractable by-products, and further comprising the steps of passing the separated vapors from said separator means to sequential condensers to condense sequentially in order of condensation temperatures the by-product and remove by-product materials and alcohol.

4. The method of claim 1 comprising the steps of separating the solid particulate material into different sizes.

5. The method of claim 1 wherein said fluid material is pressurized by a pumping means which pumps said fluid material under pressure to a heating means and then to said expansion means whereby said steps are carried out continuously.

6. The method of claim 1 wherein said fluid material is heated to a temperature of at least about 200° F. above ambient temperature.

7. The method of claim 6 wherein said fluid material is heated to a temperature of at least 600° F. above ambient temperature.

8. The method of claim 7 wherein said fluid material is heated to a temperature of at least 700° F. above ambient and sufficient to break down the alcohol into atomic hydrogen for combination with sulfur for removal of sulfur from the carbonaceous fuel particles.

* * * * *